US008267646B2

(12) United States Patent
Robertson

(10) Patent No.: US 8,267,646 B2
(45) Date of Patent: Sep. 18, 2012

(54) METHOD OF ASSEMBLING A MULTI-STAGE TURBINE OR COMPRESSOR

(75) Inventor: Daniel Robertson, Derby (GB)

(73) Assignee: Rolls-Royce PLC, London (GB)

( * ) Notice: Subject to any disclaimer, the term of this patent is extended or adjusted under 35 U.S.C. 154(b) by 729 days.

(21) Appl. No.: 12/457,750

(22) Filed: Jun. 19, 2009

(65) Prior Publication Data

US 2010/0034648 A1 Feb. 11, 2010

(30) Foreign Application Priority Data

Aug. 6, 2008 (GB) ..... 0814314.1

(51) Int. Cl.
*F01D 25/00* (2006.01)

(52) U.S. Cl. ..... 415/199.5; 415/209.2; 415/209.3; 415/213.1; 416/213 R; 416/234; 29/889.21

(58) Field of Classification Search ..... 415/199.5, 415/209.2, 209.3, 213.1; 29/889.21; 416/213 R, 416/234

See application file for complete search history.

(56) References Cited

U.S. PATENT DOCUMENTS

| | | | | |
|---|---|---|---|---|
| 2,972,470 | A * | 2/1961 | McCormick | 415/190 |
| 3,249,293 | A * | 5/1966 | Koff | 416/198 R |
| 3,628,922 | A * | 12/1971 | Sprenger | 29/888.025 |
| 4,016,636 | A | 4/1977 | Schneider et al. | |
| 4,118,847 | A * | 10/1978 | Mansson et al. | 29/889.2 |

FOREIGN PATENT DOCUMENTS

EP 0 475 771 A1 3/1992

* cited by examiner

*Primary Examiner* — Ninh H Nguyen
(74) *Attorney, Agent, or Firm* — Oliff & Berridge, PLC

(57) ABSTRACT

A method is disclosed for assembling a multi-stage compressor or a multi-stage turbine for use in a gas-turbine engine. The method comprises the steps of assembling a rotor drum so as to comprise a plurality of rotor discs 17, 18, and then releasably connecting a plurality of static components 38 to the assembled rotor drum 19, thus forming an intermediate structure. The intermediate structure is then inserted within an outer casing 50, preferably by lowering the outer casing 50 over the intermediate structure, whereafter the static components 38 are fixed to the outer casing 50. The static components 38 are then released from their connection to the rotor drum 19 in order to permit rotation of the drum 19 relative to the static components 38 and the outer casing 50.

20 Claims, 9 Drawing Sheets

METHOD OF ASSEMBLING A MULTI-STAGE TURBINE OR COMPRESSOR

The present invention relates to a method of assembling a multi-stage turbine or a multi-stage compressor for use in a gas turbine. The invention also relates to a gas turbine comprising a multi-stage turbine, or a multi-stage compressor assembled in accordance with the method.

It is common to use multi-stage axial compressors, and multi-stage axial turbines in modern gas turbine engines, such as aero jet engines. For example, gas turbine compressors comprise a core rotor which typically comprises between 3 and 12 rotor discs, each carrying a set of radial rotor blades around its periphery. The discs are welded or bolted together to form a rotor drum. The rotor drum is mounted for rotation within an outer casing, and the casing carries a series of static components, called stator vanes, which are arranged in rows behind respective rows of rotor blades to remove swirl from the flow of air induced through the compressor. Each rotor disc and downstream stator row form an individual stage of the compressor. Multi-stage turbines have a generally similar construction, with the static components taking the form of nozzle guide vanes (NGVs), as will be known to those of skill in the art.

There are presently a number of ways in which a multi-stage axial compressor or turbine can be designed and assembled. At the design stage it is important to strike an appropriate balance between factors such as weight of the assembly, cost, and the ability of the assembly to maintain a constant running clearance between the tips of the rotor blades and the outer casing.

As will be appreciated, given that the static components must be mounted to the outer casing, but extend between rows of rotating rotor blades, careful consideration must be given at the design stage as to how the static components and the rotor blades will be assembled. Put simply, the issue is how to overcome the problem of the rotor blades obstructing easy installation of the static components, and vice-versa, at the installation stage.

One of the most simple known methods of assembling a multi-stage turbine or compressor is to form the outer casing as a longitudinally-split casing made up of two two pieces, each piece having a respective flange running along the length of the casing. The two halves of the casing are brought together around the rotor drum and are secured to one another by a plurality of bolts passing through the two lined flanges. FIG. 1 illustrates this assembly method in schematic form. The rotor drum 1 is initially substantially completely assembled so as to comprise a plurality of spaced-apart rotor discs 2, each having a series of radial rotor blades 3 around its periphery. The static components 4 are arranged into rows and secured in positions inside each half 5, 6 of the casing. The assembled rotor drum 1 is then lowered into the lower half of the casing 5 such that the rows of rotor blades 3 become inter-digitated with the rows of static components 4 arranged in the lower half of the casing 5. The upper half of the casing 6 is then lowered over the assembled rotor drum 1 in order to close the casing and the two halves of the casing are then secured to one another by a plurality of bolts 7 passing through aligned apertures formed in the respective mounting flanges 8, 9.

From the point of view of cost, this method can be advantageous because it allows the rotor drum 1 to be formed in a single piece, for example by welding together the plurality of rotor discs 2, and thus reduces assembly time relative to a method in which the adjacent rotor discs 2 must themselves be bolted together. A single piece rotor drum of this type is also advantageous on aero engines as it has a reduced mass relative to a rotor comprising a series of rotor discs which are bolted to one another.

However, a gas turbine engine assembled in accordance with such a method so as to have a longitudinally split outer casing, has been found to suffer some problems. The fact that the outer casing of the engine is split into two halves can cause the casing to become ovalised as the engine runs through a typical flight cycle. This can result in uneven running clearances between the tips of the rotor blades 3 and the outer casing, with running clearances opening up around some points of the rotor and closing up at other points. This can cause large over-tip losses in the turbine in regions where the running clearance opens up, and can cause the tips of the rotor blades to rub against the outer casing in regions where the running clearance closes up. Also, the relatively large longitudinal mounting flanges 8, 9 can add significantly to the weight of the turbine casing.

Because of these problems, the longitudinally split casing design tends to be used mainly on large ground-based power turbines, because in such applications the large physical size of the turbine rotor means that the assembly method is favoured because of its simplicity. The problem of ovality can be more easily addressed in a ground-based power turbine by designing the relevant sections of the turbine casing to be oval at room temperature and to become circular at working temperatures. This is not generally possible on an aero engine where the engine must operate efficiently through a wide range of operating temperatures and pressures over the course of a typical flight cycle. Additionally, ground-based power turbines are not subject to the sort of changing thrust and gravitational loadings as an aero engine would be.

The problem of ovality on longitudinally-split compressor casings can be addressed by locating the static components on a continuous internal ring which is not subject to significant pressure and which can be held on pins spaced 180° apart within the outer casing, so that the change in casing ovality does not affect the internal ring. However, this modification does have the problem of introducing another weight disadvantage and can add significantly to the complication of the casing structure.

Another method of assembling a multi-stage turbine is to split the casing transversely so as to provide a separate section of casing for each stage of the multi-stage turbine. FIG. 2 illustrates this assembly method in schematic form. The rotor drum 1 is built-up so as to comprise a plurality of spaced apart rotor discs 2, each having a separate set of rotor blades 3 provided around its periphery. Each section of the casing 10, 11, 12 is then added, with its respective static components mounted inside, the casing sections 10, 11, 12 being introduced in sequence, beginning with the largest diameter section 10 corresponding to the largest diameter rotor disc 2. Neighbouring casing sections are secured to one another via transverse mounting flanges 13, and bolts 7.

The transversely split casing design illustrated in FIG. 2 can be tuned to give very good blade tip clearance because the casing section provided around each stage of the turbine or compressor can be designed so as to expand with the same time-constant as the rotating components of the stage. Also, because each section of the casing takes the form of a complete ring, there is less of a problem with the completed casing ovalising during operation.

Although the transversely-split casing design can be used for diverging turbines such as that illustrated in FIG. 2 (or converging compressors), it lends itself particularly well to the assembly of high pressure turbines of aero engines, because high pressure turbines typically have stages of approximately equal diameter, thereby significantly simplifying the assembly.

However, transversely split casing designs can suffer from their own problems. For example they are typically significantly heavier than other turbine/compressor casing designs. This is because the transversely split casings have two sets of flanges and one set of bolts at each stage of the assembly. Also, because of the higher number of component parts which must be joined to one another in order to form the complete casing, tolerance issues can be magnified. Furthermore, due to the large number of additional parts making up the overall assembly, this sort of casing design requires significantly more time to assemble and disassemble.

Another assembly method, which has been used extensively in the production of low pressure turbine casings used in high by-pass aero engines, is illustrated schematically in FIG. 3, and involves the use of a single-piece, seamless outer casing 14. In this arrangement, the turbine stages are assembled one at a time, with the static components being fixed inside the casing 14 before each rotor disc 2 is added in turn. For example, in the arrangement illustrated in FIG. 3, the smallest rotor disc 2 would be inserted into the outer casing 14, after which the corresponding set of static components would be fixed around the inside of the casing 14. The next rotor disc 2 is then inserted into the casing, whereafter the next row of static components are installed within the casing, and so on. Clearly, in this assembly method, the rotor drum 1 cannot be of single piece construction (for example made up by welding adjacent rotor discs to each other, and so instead each rotor disc 2 is provided with an annular flange 15 which is arranged to mate with a corresponding annular flange on the adjacent rotor disc, the two flanges being secured to one another by a series of bolts 16.

Although the seamless casing design and assembly method illustrated schematically in FIG. 3 offers advantages in terms of the weight of the turbine casing 14, whilst also reducing the problem of ovality compared to the longitudinally split casing design, the method and design is not without its own problems. As will be appreciated, for a multi-stage compressor or turbine having a large number of stages, the resulting large number of mating flanges 15 and fixing bolts 16 can add significantly to the overall weight of the rotor 1 which can be a particular problem given that this additional weight is provided on a rotating component. It has been calculated that for a large modern aero engine, a low pressure multi-stage turbine built in accordance with this design could have as much as 20 to 50 kg of its total weight made up by the mating flanges 15 and the fixing bolts 16.

It is an object of the present invention to provide an improved method of assembling a multi-stage compressor or turbine for use in a gas-turbine engine. It is a further object of the present invention to provide a gas-turbine engine comprising a multi-stage compressor, or a multi-stage turbine assembled by such a method.

Accordingly, a first aspect of the invention provides a method of assembling a multi-stage compressor or turbine for use in a gas-turbine engine, the method comprising the steps of: i) assembling a rotor drum so as to comprise a plurality of axially arranged rotor discs, ii) releasably connecting a plurality of static components to the assembled rotor drum, to form an intermediate structure, iii) inserting the intermediate structure within an outer casing, iv) fixing the plurality of static components to the outer casing, and v) releasing the static components from the rotor drum to permit rotation of the drum relative to the static components and the outer casing.

Preferably, the casing is formed as a unitary component.

The step of assembling the rotor drum preferably includes the step of welding the rotor discs to one another. Additionally, the step of assembling the rotor drum may include attaching a plurality of rotor blades to at least one of the rotor discs, and at least one of the rotor discs can take the form of an integrally bladed disc.

Preferably, each static component is releasably connected to the rotor drum by at least one removable fixing element. Each said removable fixing element can be inserted through a respective hole provided in the rotor drum, and may be subsequently removed during said step of releasing the static components from the rotor drum. The method may include the further step of closing said holes after removal of said fixing elements.

The assembly method preferably comprises the step of providing the rotor drum on an assembly mount, with the fixing elements being releasably secured to the assembly mount. At least part of the assembly mount may be provided in a position within the rotor drum, with the fixing elements extending substantially radially outwardly from the mount.

In a preferred method, the rotor drum is actually assembled on the assembly mount, optionally with its rotational axis oriented substantially vertically, and with the rotor drum remaining in said orientation during the step of releasably connecting the static components. In such a method, the step of inserting the intermediate structure within the outer casing comprises lowering the outer casing over the intermediate structure. For convenience, the rotor drum may be assembled with its smallest diameter rotor disc uppermost.

Preferably, the method comprises the further step of connecting the rotor drum to a shaft after the step of releasing the static components from the rotor drum.

Each static component may be provided with a substantially axially extending projection in its radially outermost region, with said step of fixing the static components to the outer casing comprising engaging each said projection in a corresponding slot provided inside the outer casing.

Each static component may be provided with a substantially radially extending tab at its radially outermost region, and said step of fixing the static components to the outer casing may comprise rotating the outer casing relative to the intermediate structure so that each said radially extending tab becomes radially aligned with a respective inwardly directed tab provided inside the outer casing.

The step of rotating the outer casing relative to the intermediate structure preferably involves rotation in the same direction to that in which rotational forces will act on the static components (38) relative to the outer casing (50) during operation of the compressor or turbine (i.e. rotation in the same direction to that in which rotational forces will act tending to urge the static components and the casing apart.

In a preferred method according to the present invention, the step of inserting the intermediate structure within the outer casing involves moving each said inwardly directed tab axially past a respective said radially extending tab, prior to said rotation of the outer casing relative to the intermediate structure.

The outer casing may be provided with inwardly directed abutments, each arranged to abut part of a static component when the radially extending tabs become aligned with respective inwardly directed tabs, thereby defining a limit to the rotation of the outer casing relative to the intermediate structure.

According to a further aspect of the present invention, there is provided a gas turbine engine comprising a multi-stage turbine or compressor assembled according to the method outlined above.

So that the invention may be more readily understood, and so that further features thereof may be appreciated, embodiments of the invention will now be described, by way of example, with reference to the accompanying drawings in which.

An embodiment of the assembly method of the present invention will now be described with particular reference to FIGS. 4 to 9 which show successive stages through a method of assembling an axial multi-stage turbine for an aero engine, and in particular a low pressure turbine (LP). However, it should be appreciated that the method is also appropriate for the assembly of other types of axial multi-stage turbines, and also axial multi-stage compressors.

Figure 4:
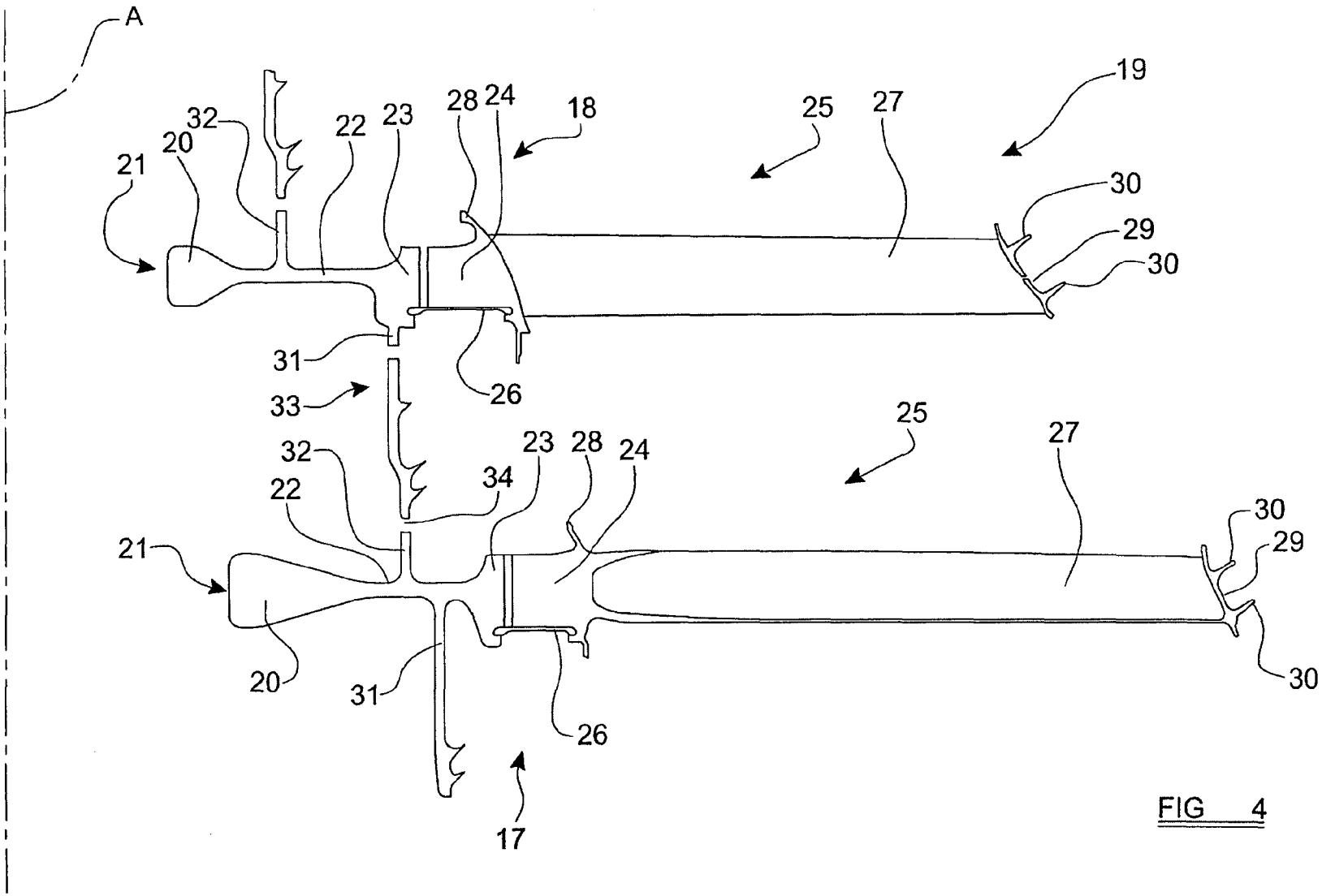
FIG. 4 is a longitudinal cross-sectional view through part of a turbine rotor, illustrating an initial stage in the assembly method of the present invention.

FIG. 4 illustrates an early stage in the assembly method of the invention, and shows two adjacent rotor discs 17, 18 which make up part of a turbine rotor drum indicated generally at 19. FIG. 4 illustrates the adjacent rotor discs 17, 18 in a generally horizontal plane, and shows one half of each disc in cross-section, to the right hand side of the axis of rotation A of the rotor drum 19. The rotor drum 19 is preferably assembled in this orientation, with its rotational axis A oriented substantially vertically, and may comprise several adjacent rotor discs. As will be seen from FIG. 4, the lower of the two rotor discs illustrated has a large diameter relative to the other disc, and during assembly of the rotor drum 19, the drum 19 is oriented such that the smallest rotor disc, forming part of the smallest stage of the turbine, is located uppermost. As will become clear subsequently, this facilitates easier insertion of the assembled rotor drum 19 within the outer casing of the turbine during a subsequent stage of the assembly method.

Each rotor disc 17, 18 comprises a relatively massive central portion 20, which is commonly known as the cob 20 of the disc. The cob 20 surrounds a central aperture 21 by means of which the rotor disc will be fixed to a shaft in the gas turbine engine.

The cob 20 of each disc narrows in a radially outward direction to form a relatively thin web region 22 which carries a blade mounting flange 23. In a generally conventional manner, the blade mounting flange 23 of each disc is provided with a series of slots around its outer periphery, each slot being configured to receive the root 24 of a respective rotor blade 25. Although the blade roots 24 are illustrated in simplified form in the drawings for the sake of clarity, it will be appreciated that the root 24 will usually have a "fir-tree" configuration for receipt within correspondingly shaped slots, as is conventional.

Each rotor disc 17, 18 is thus provided with a plurality of radially arranged rotor blades 25, and the blades 25 are retained in position relative to the mounting flange 23 by a generally annular blade retention loop 26, as is also conventional.

Each rotor blade 25 has an elongate region 27 of aerofoil configuration which extends between a radially innermost blade platform 28 and a radially outermost shroud section 29 at its tip. The shroud section of each rotor blade 25 carries a pair of spaced apart shroud tip fins 30.

Figure 1:
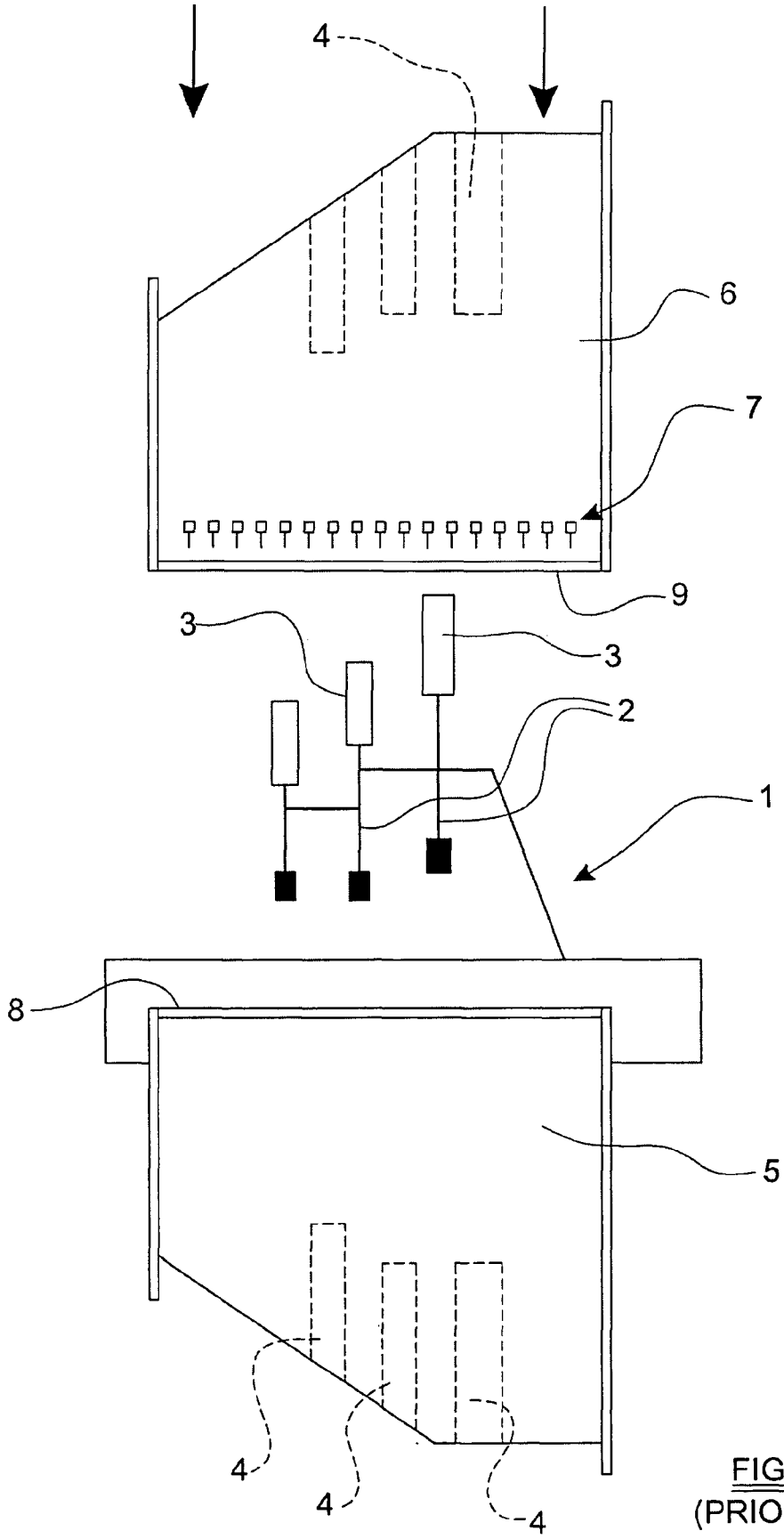
FIG 1 (PRIOR ART)
FIG. 1 shows, in schematic form, a prior art compressor/turbine design and assembly method.
Figure 2:
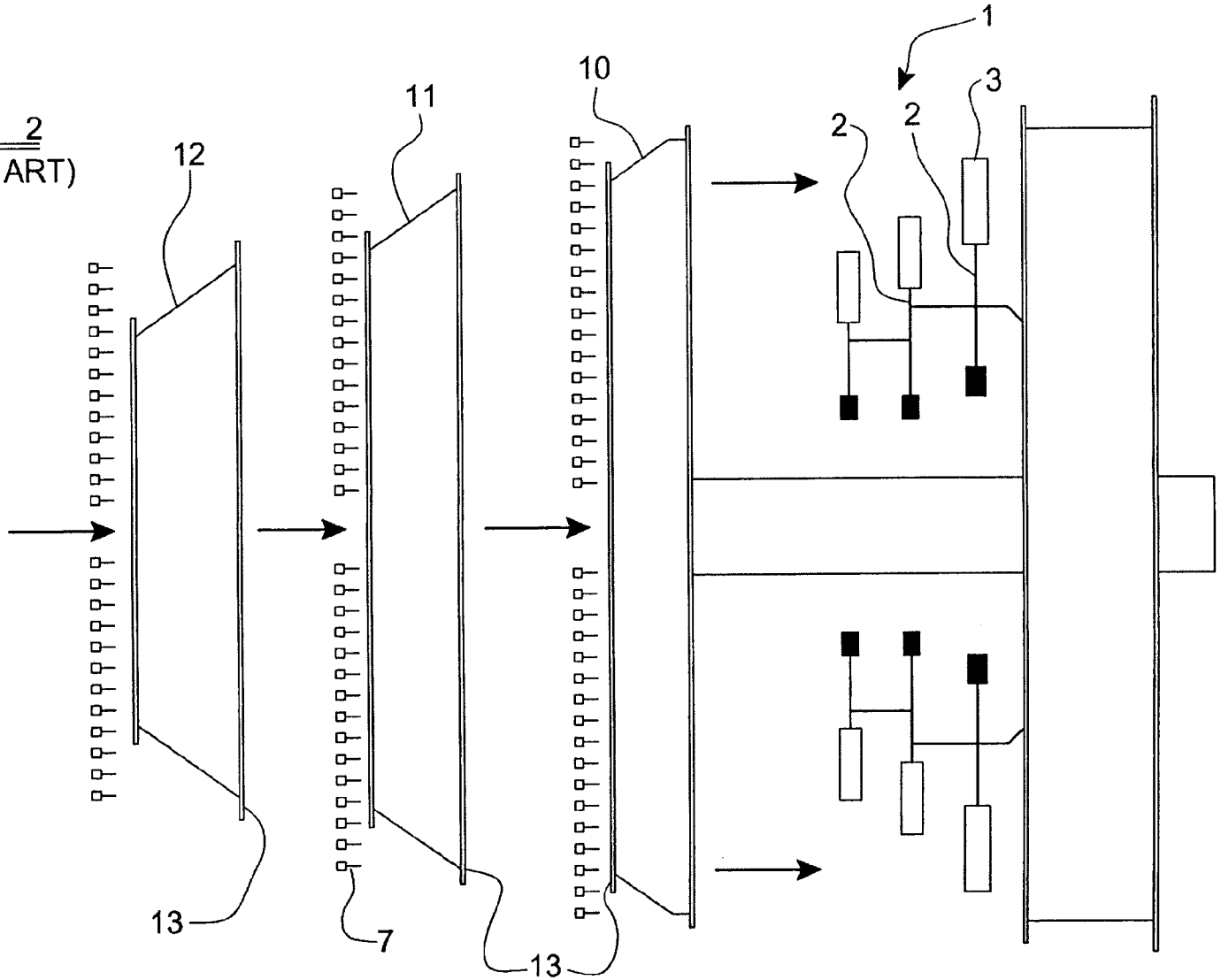
FIG 2 (PRIOR ART)
FIG. 2 illustrates, in schematic form, another prior art compressor/turbine assembly method.
Figure 3:
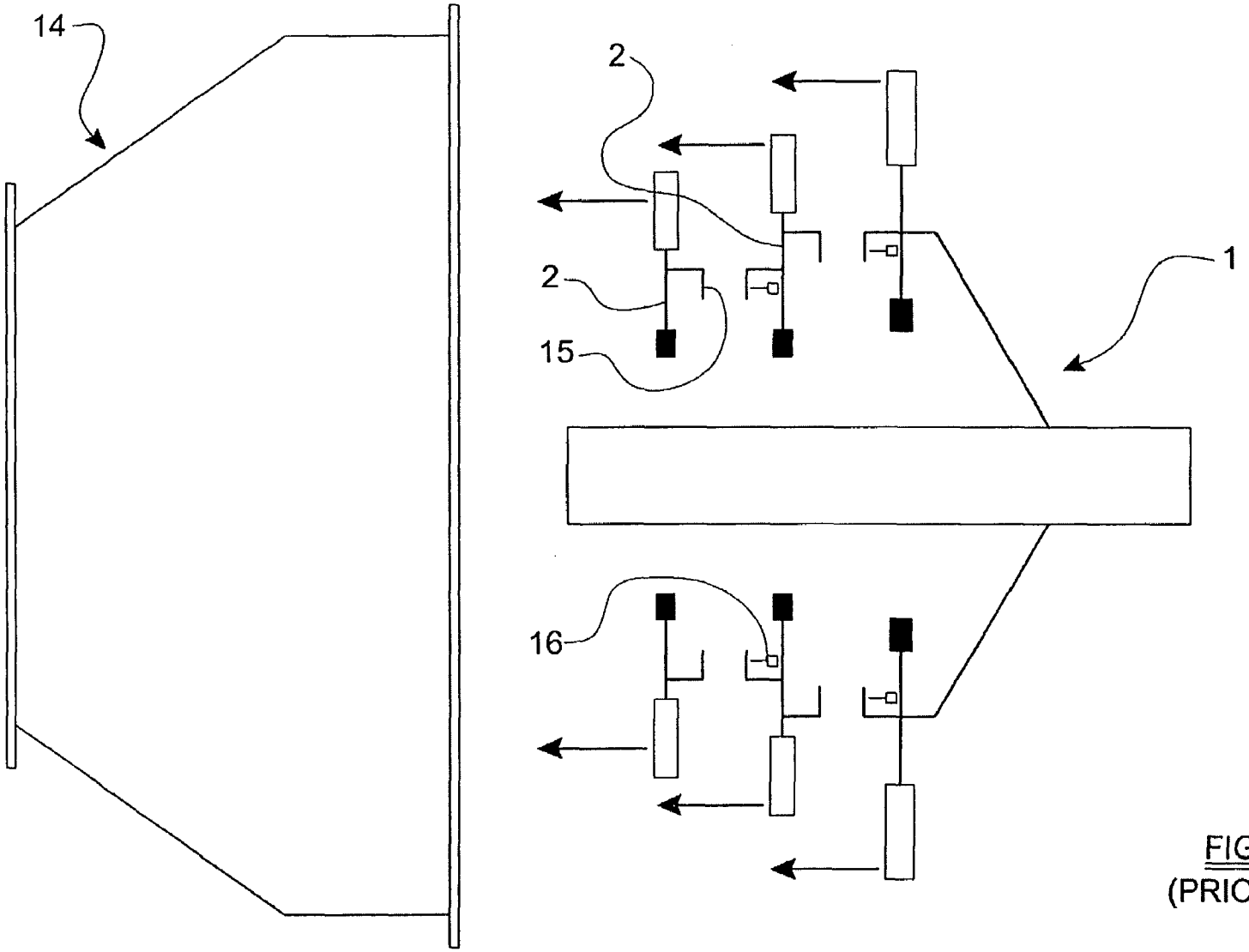
FIG 3 (PRIOR ART)
FIG. 3 illustrates, in schematic form, another prior art compressor/turbine assembly method.

In the assembly orientation of the rotor discs illustrated in FIG. 4, it will be seen that each disc has a lower annular flange 31 extending downwardly from the web 20, and an upper annular flange 32 extending upwardly from the web 22, the upper flange 32 being located radially inwardly of the lower flange 31. The smaller upper disc 18 is secured to the larger lower disc 17 by way of interconnection between the downwardly extending flange 31 of the upper disc and the upwardly extending flange 32 of the lower disc. It should therefore be appreciated that in practice, a whole series of rotor discs can be welded to one another in this manner to form a single-piece rotor drum (as opposed to a multi-piece rotor drum comprising a plurality of rotor discs which are bolted together in the manner illustrated in FIG. 3).

Whilst assembly of the complete rotor drum 19 has been described above with reference to there being a mechanical connection between each rotor blade 25 and its associated rotor disc, it should be appreciated that the method of the present invention could incorporate rotor discs in the form of integrally bladed discs (i.e. single-piece components comprising a rotor disc and a plurality of blades machined from a solid piece of material or with the blades being welded to the central disc).

As can be clearly seen from FIG. 4, the inter-connected flanges 31, 32 of the adjacent rotor discs together define an annular drum section 33 extending between the two discs. This drum section is provided with a plurality of mounting holes 34 at positions spaced radially around the interconnecting drum section 33. In the particular arrangement illustrated in FIG. 4, the mounting holes 34 are provided in two rows, one of the rows being located generally adjacent the upper rotor disc 18, and the other row of holes being located generally adjacent the lower rotor disc 17.

Figure 5:
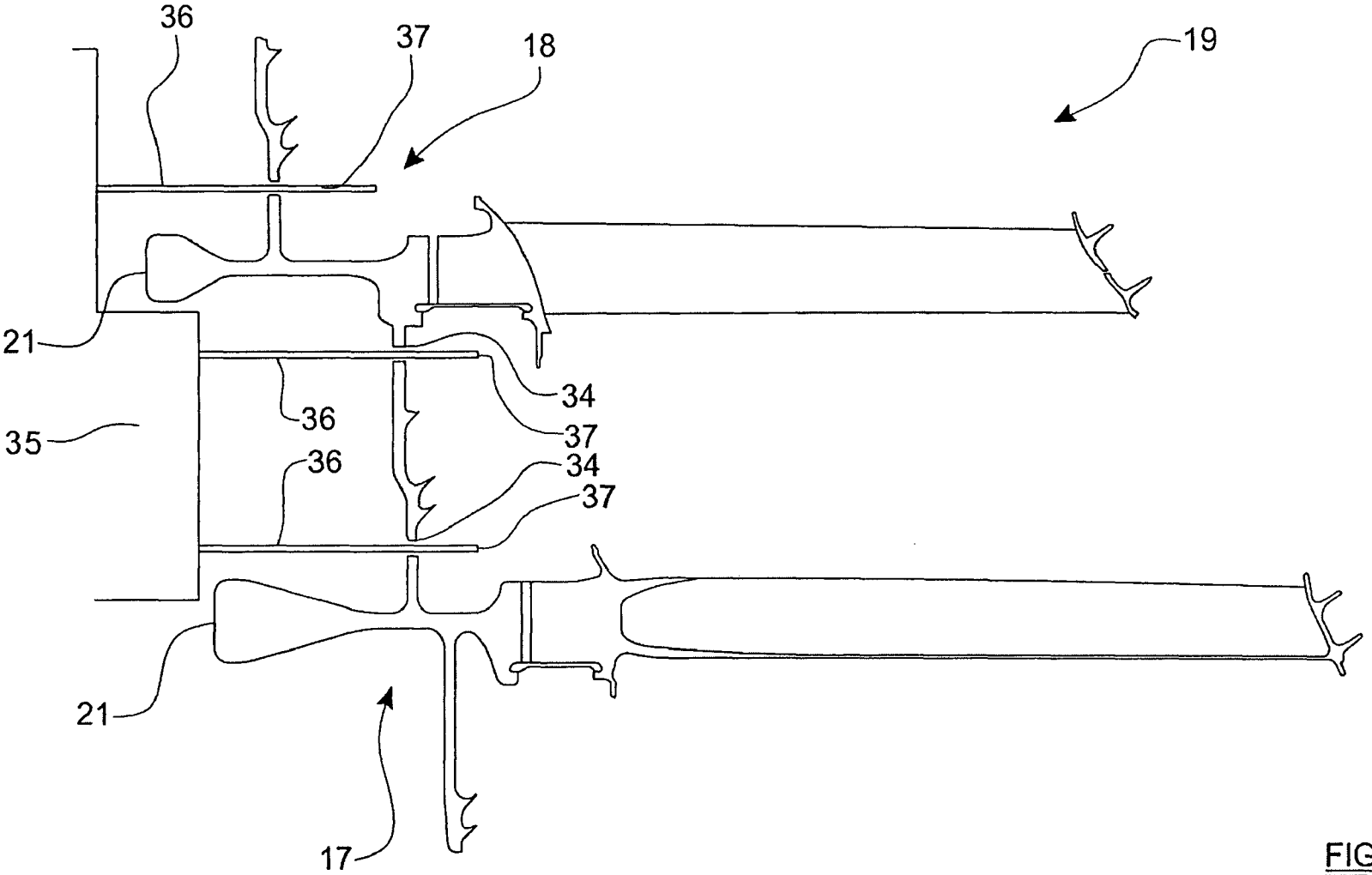
FIG. 5 is a view corresponding generally to that of FIG. 4, illustrating a subsequent stage of the assembly method.

Turning now to consider FIG. 5, the assembled rotor 19 is shown mounted on a generally vertically extending assembly mount 35, the assembly mount having a stepped configuration so as to extend through the axially-aligned central apertures 21 of the rotor discs 17, 18. Although it is possible to assemble the rotor drum 19 before mounting it on the assembly mount 35, it is preferred that the rotor drum 19 is actually assembled in position on the assembly mount 35.

Either during assembly of the rotor drum 19 on the assembly mount 34, or after the rotor drum has been assembled and then mounted on the assembly mount 35, a fixing element 36 is inserted through each mounting hole 34 so as to extend radially outwardly from the assembly mount 35, and to terminate with a free end 37 spaced radially outwardly from the respective mounting hole 34. Each fixing element 36 preferably takes the form of an elongate metal pin arranged to extend outwardly from the assembly mount 35. Each fixing element 36 can thus be mounted for selective radial extension through an appropriate aperture formed in the assembly mount 35.

Figure 6:
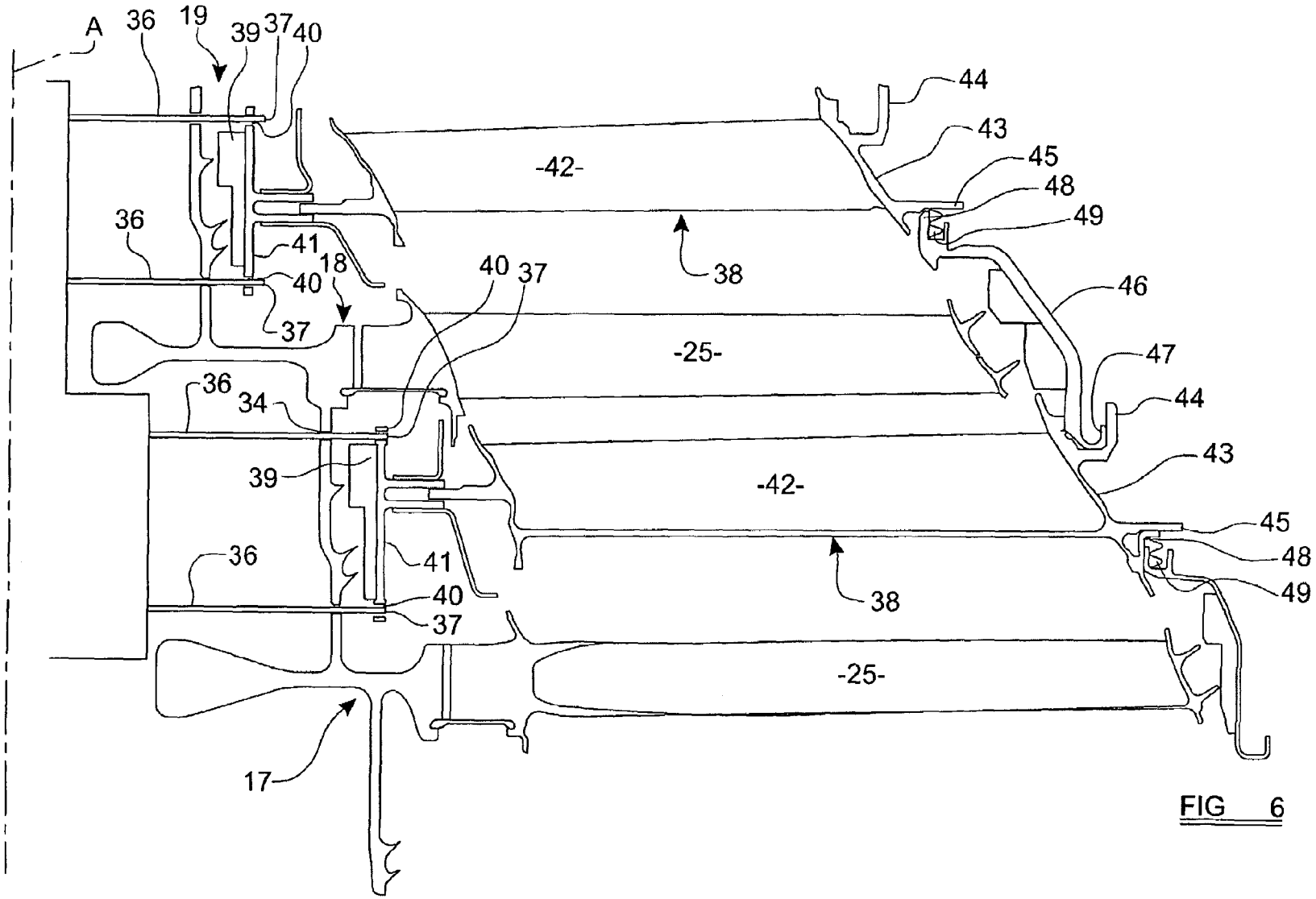
FIG. 6 is a view corresponding generally to that of FIG. 5, illustrating a further stage in the assembly method of the present invention.

As illustrated most clearly in FIG. 6, following insertion of the fixing element 36 though respective mounting holes 34 formed in the assembled rotor drum 19, the static components 38 of the turbine (or compressor) are then inserted into the spaces formed between adjacent rows of rotor blade 25. In the case of a turbine, as illustrated in the accompanying drawings, then it will be appreciated that the static components 38 take the form of nozzle guide vanes (NGVs), whilst in the case of a compressor, the static components would take the form of stator vanes. In either case, the radially innermost region of each static component 38 is releasably secured relative to the assembled rotor drum 19 by engagement with the radially projecting ends of the fixing elements 36.

In the arrangement illustrated in FIG. 6, showing the static components 38 in the form of NGVs, it will be seen that the fixing elements 36 serve to connect the NGV seals 39 to the assembled rotor drum 19. The outermost end 37 of each fixing element 36 is received through a corresponding mounting aperture 40 provided through the inner shroud section 41 of each NGV.

As is generally conventional, it will be seen that each of the NGVs illustrated comprises a radially outwardly extending vane 42, of aerofoil configuration, carrying an outer shroud section 43 at its outermost end. Each outer shroud section 43 carries an upwardly directed, axially extending projection 44, in the form of a hook, and an outwardly directed, radially extending tab 45.

As also illustrated in FIG. 6, the two NGVs 42 are shown interconnected at their radially outermost ends by a seal-segment 46, the seal-segment being arranged to pass around the radially outermost end of the adjacent rotor blade 25. The seal-segment 46 is provided with an upturned lip 47 at its lowermost edge, the upturned lip 47 being configured to conform to the inner profile of the recess defined by the hook 44 of the larger diameter NGV. At its uppermost edge, the seal segment 46 is provided with an axially directed lip 48 which is arranged to bear against the radially outwardly directed tab 45 of the adjacent smaller diameter NGV, and which carries an outwardly directed convolute seal 49.

It should be noted that at the assembly stage illustrated in FIG. 6, the static components 38 are effectively releasably secured to the assembled rotor drum 19 so that were the rotor drum 19 to be rotated about its vertically oriented axis of rotation A, the static components would all rotate with the drum. The combination of the releasably connected static components and the rotary components making up the rotor drum can therefore be considered to represent an intermediate structure.

Figure 7:
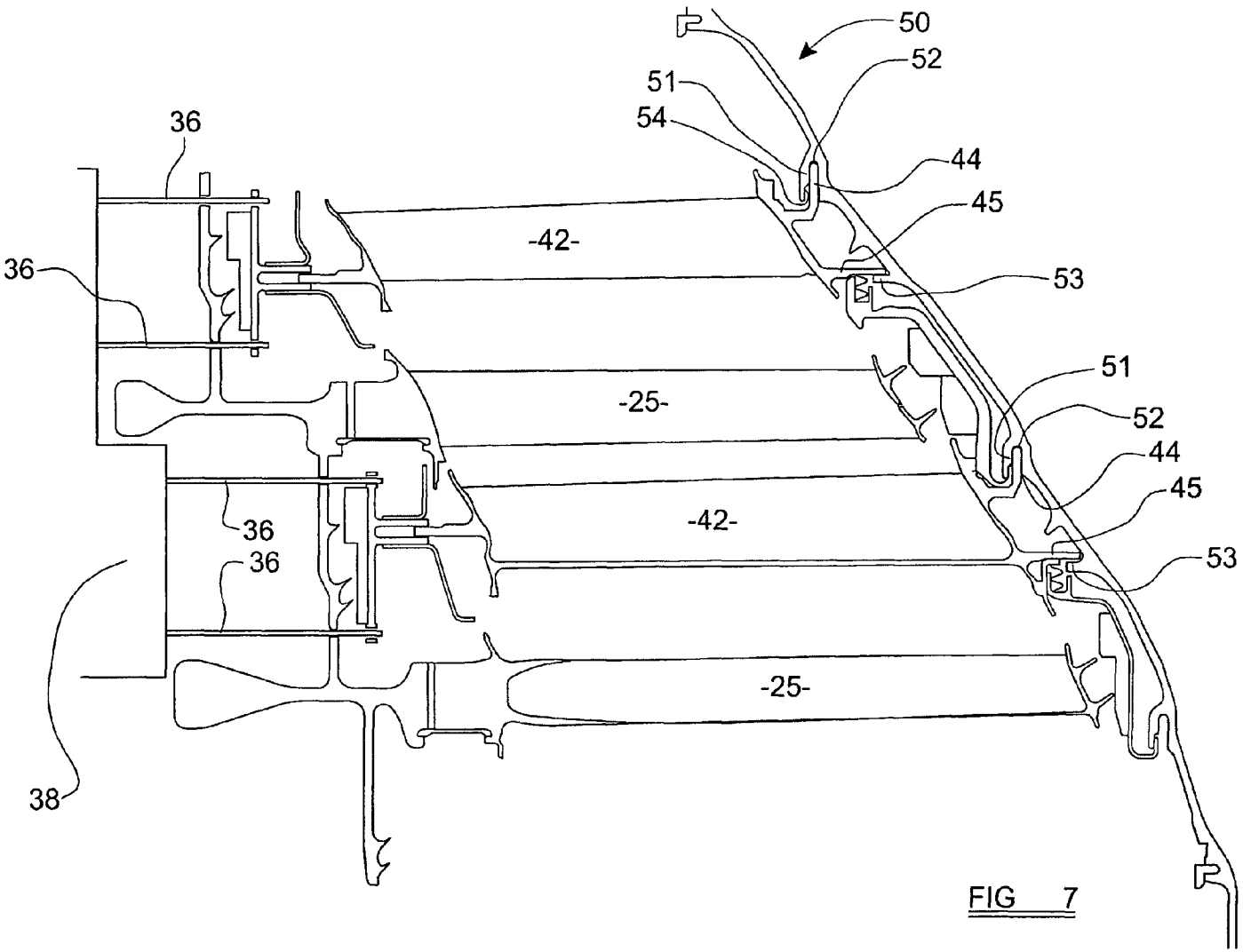
FIG. 7 is a view corresponding generally to that of FIG. 6, illustrating a still further stage in the assembly method of the present invention.

As illustrated in FIG. 7, the intermediate structure formed from the releasably connected static and rotary components is then inserted within an outer casing 50. In practice, this is effected by lowering the casing 50 over the intermediate structure which is mounted on the vertically oriented assembly mount 35. As will be apparent to the skilled reader, the outer casing 50 is substantially frustoconical in form in order to accommodate the tapering nature of the multi-stage turbine (or compressor) installed within it.

The outer casing 50 is provided with a series of internal features arranged for connection with the static components of the intermediate structure. For example, the outer casing 50 is provided with downwardly directed, axially extending flanges 51, each of which defines a respective axially oriented slot 52 to receive the hooks 44 of each row of NGVs 42. The hooks 44 are received within the slots 52 as the outer casing 50 is lowered over the intermediate structure. Engagement of the hooks 44 within the slots 52 serves to restrain the static components 38 in a radial sense.

The outer casing 50 is also provided with a series of inwardly directed tabs 53, each of which is arranged to cooperate with a respective outwardly directed tab 45. The outer casing 50 is lowered over the intermediate structure such that the inwardly directed tabs 53 on the casing are radially offset from the outwardly directed tabs 45 provided on the static components. The casing 50 is lowered over the intermediate structure so that the inwardly directed tabs 53 move past the outwardly directed tabs 45, as the hooks 44 become engaged within the slots 52. The casing 50 is then rotated relative to the intermediate structure in order to bring the inwardly directed tabs 53 into radial alignment with their respective outwardly directed tabs 45. A bayonet-type connection is thus provided between the outer casing and the radially outermost ends of the static components 38.

It is preferred that the above-mentioned step of rotating the outer casing 50 relative to the intermediate structure involves rotation in the same direction to that in which rotational forces will act on the static components relative to the outer casing during operation of the completed turbine (or compressor).

It is to be noted that each downwardly directed flange 51 provided inside the casing has a small notch 54 formed in its lowermost edge. The notch 54 is arranged to receive the uppermost edge of the upturned lip 47 provided on the seal segment 46, thereby securing the seal segment 46 in position as the casing 50 is installed over the intermediate structure.

Figure 8:
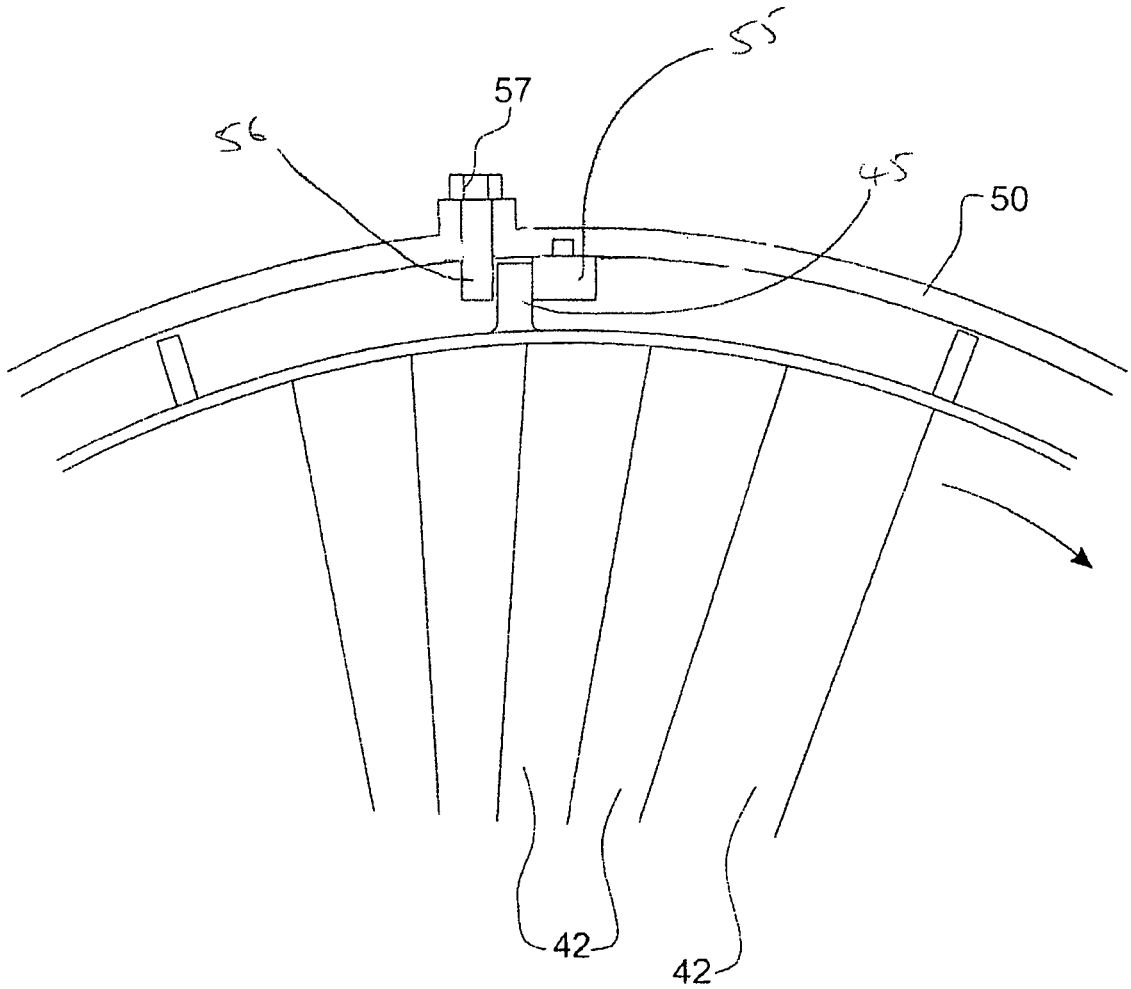
FIG. 8 is a transverse cross-sectional view illustrating a further stage in the assembly method of the present invention.

In order to provide a limit to the degree of rotation which is permitted between the intermediate structure and the outer casing 50 as they are connected in this bayonet-type fashion, the outer casing 50 is provided with a number of inwardly directed abutments 55, as illustrated most clearly in FIG. 8. Each abutment 55 is arranged to engage a respective outwardly directed tab 45 on the static component 38, when the tab 45 is radially aligned with a respective inwardly directed tab 53 carried by the casing. The abutments 55 are arranged to prevent further rotation of the static components relative to the outer casing 50 in the direction in which the static components will tend to be urged under the flow of gas during operation of the finished turbine (or compressor).

A number of securing elements 56 may then be inserted through appropriate apertures 57 formed in the outer casing 50. The securing elements 56 are each positioned on the opposite side of a respective tab 45 to the adjacent abutment 55 and thus serve to restrain rotation of the static components relative to the outer casing in the opposite direction to that used to make up the bayonet connection. In a preferred embodiment, the securing elements 56 take the form of pins, or threaded bolts, which may be screwed into the casing 50 from the outside.

As will therefore be appreciated, at this stage in the assembly of the turbine (or compressor), the static components 38 are all fixed to the outer casing 50 at their radially outermost regions.

Figure 9:
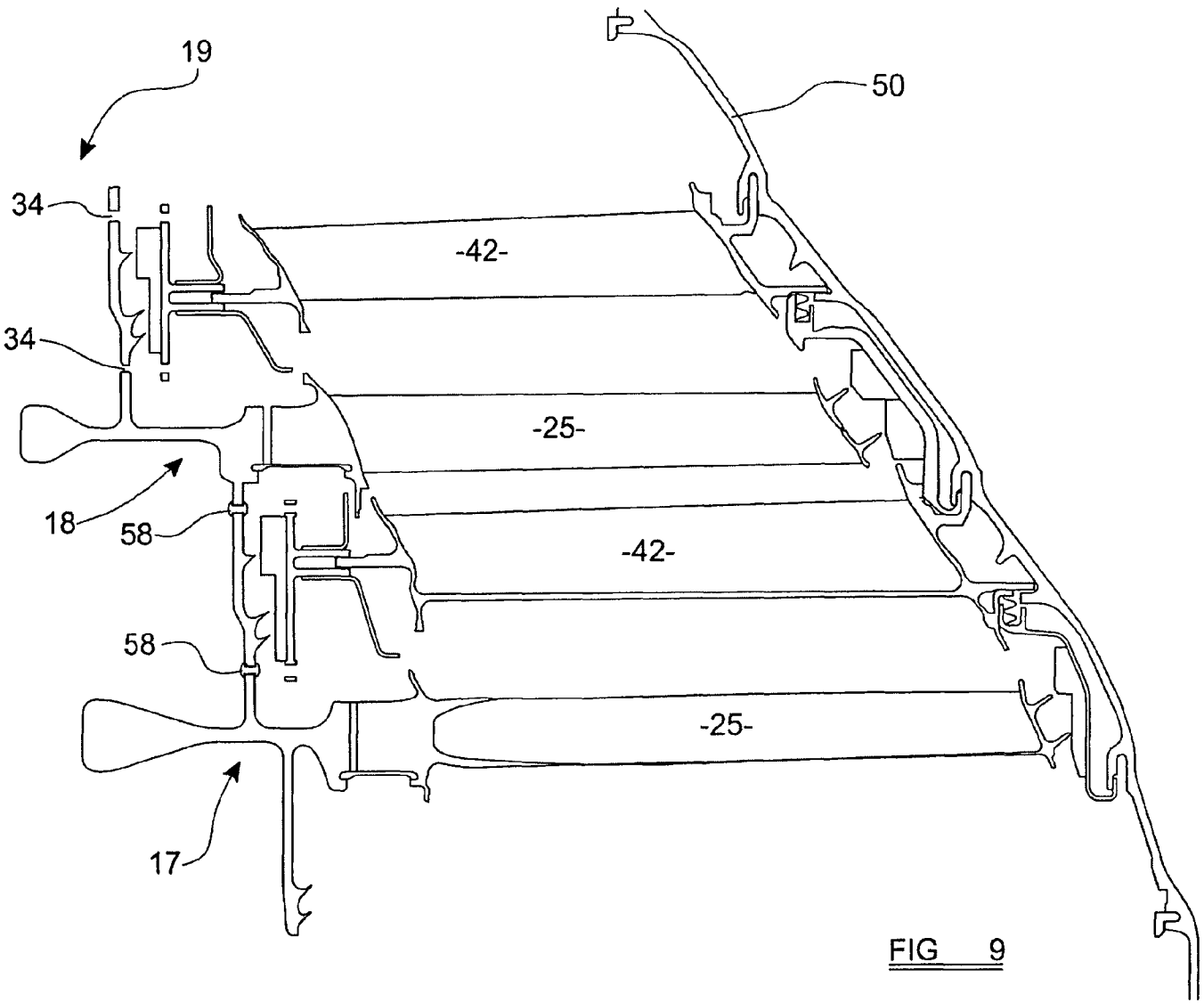
FIG. 9 is a view corresponding generally to that of FIG. 7, illustrating a further stage of the assembly method of the present invention.

FIG. 9 illustrates a subsequent stage in the assembly method of the present invention, and shows the static components 38 having been released from their connection to the rotor drum 19 by removal of the fixing elements 36. FIG. 9 also shows the assembly mount 35 having been removed from the rotor drum 19, whereafter the rotor drum 19 can be mounted on an engine shaft in a generally conventional manner. Following removal of the fixing elements 36, it will therefore be appreciated that the static components 38, as represented by the nozzle guide vanes 42, are fixed in position relative to the casing 50, whilst the rotor blades 25 and the associated rotor discs 17, 18 are now free to rotate relative to the static components 38 and the outer casing 50.

It is envisaged that in some installations, the mounting holes 34 provided in the rotor drum 19 could be left open in order to serve a cooling function for the flow of cooling air. However, in other arrangements it is envisaged that at least some of the holes 34 could be closed, for example by the insertion of respective plugs 58 as shown in FIG. 9.

While the invention has been described in conjunction with the exemplary embodiments described above, many equivalent modifications and variations will be apparent to those skilled in the art when given this disclosure.

Accordingly, the exemplary embodiments of the invention set forth above are considered to be illustrative and not limiting. Various changes to the described embodiments may be made without departing from the spirit and scope of the invention.

The invention claimed is:

1. A method of assembling one of a multi-stage compressor and turbine for use in a gas-turbine engine, the method comprising the steps of: i) assembling a rotor drum so as to comprise a plurality of axially arranged rotor discs, ii) releasably connecting a plurality of static components to the assembled rotor drum, to form an intermediate structure, iii) inserting the intermediate structure within an outer casing, iv) fixing the plurality of static components to the outer casing, and v) releasing the static components from the rotor drum to permit rotation of the drum relative to the static components and the outer casing.

2. A method according to claim 1, wherein the casing is formed as a unitary component.

3. A method according to claim 1, wherein the step of assembling the rotor drum includes the step of welding the rotor discs to one another.

4. A method according to claim 1, wherein the step of assembling the rotor drum includes attaching a plurality of rotor blades to at least one of the rotor discs.

5. A method according to claim 1, wherein at least one of said rotor discs takes the form of an integrally bladed disc.

6. A method according to claim 1, wherein each static component is releasably connected to the rotor drum by at least one removable fixing element.

7. A method according to claim 6, wherein each said removable fixing element is inserted through a respective hole provided in the rotor drum, and is subsequently removed during said step of releasing the static components from the rotor drum.

8. A method according to claim 7, including the further step of closing said holes after removal of said fixing elements.

9. A method according to claim 6, comprising the step of mounting the rotor drum on an assembly mount, said fixing elements being releasably secured to the assembly mount.

10. A method according to claim 9, wherein at least part of the assembly mount is provided within the rotor drum, said fixing elements being provided to extend substantially radially outwardly from the mount.

11. A method according to claim 9, wherein the rotor drum is assembled on the assembly mount.

12. A method according to claim 1, wherein the rotor drum is assembled with its rotational axis oriented substantially vertically, the rotor drum remaining in said orientation during the step of releasably connecting the static components, and wherein said step of inserting the intermediate structure within the outer casing comprises lowering the outer casing over the intermediate structure.

13. A method according to claim 12, wherein the rotor drum is assembled with its smallest diameter rotor disc uppermost.

14. A method according to claim 1 comprising the further step of connecting the rotor drum to a shaft after the step of releasing the static components from the rotor drum.

15. A method according to claim 1, wherein each static component is provided with a substantially axially extending projection in its radially outermost region, and said step of fixing the static components to the outer casing comprises engaging each said projection in a slot provided inside the outer casing.

16. A method according to claim 1, wherein each static component is provided with a substantially radially extending tab at its radially outermost region, and said step of fixing the static components to the outer casing comprises rotating the outer casing relative to the intermediate structure so that each said radially extending tab becomes radially aligned with a respective inwardly directed tab provided inside the outer casing.

17. A method according to claim 16, wherein said step of rotating the outer casing relative to the intermediate structure involves rotation in the same direction to that in which rotational forces will act on the static components relative to the outer casing during operation of the compressor or turbine.

18. A method according to claim 16, wherein said step of inserting the intermediate structure within an outer casing involves moving each said inwardly directed tab axially past a respective said radially extending tab, prior to said rotation of the outer casing relative to the intermediate structure.

19. A method according to claim 16, wherein said outer casing is provided with inwardly directed abutments, each arranged to abut part of a static component when the radially extending tabs become aligned with respective inwardly directed tabs, thereby defining a limit to the rotation of the outer casing relative to the intermediate structure.

20. A gas turbine engine comprising a multi-stage turbine or compressor assembled according to the method of claim 1.

* * * * *